US005964066A

United States Patent [19]

Mori

[11] Patent Number: 5,964,066

[45] Date of Patent: Oct. 12, 1999

[54] EARTHQUAKE-PROOF FOUNDATION

[76] Inventor: Kuninori Mori, 554-7-202, Kunugida-machi, Hachioji-shi, Tokyo 193, Japan

[21] Appl. No.: 08/913,245

[22] PCT Filed: Feb. 19, 1996

[86] PCT No.: PCT/JP96/00357

§ 371 Date: Dec. 11, 1997

§ 102(e) Date: Dec. 11, 1997

[87] PCT Pub. No.: WO96/29477

PCT Pub. Date: Sep. 26, 1996

[30] Foreign Application Priority Data

Mar. 17, 1995 [JP] Japan ..... 7-097385

[51] Int. Cl.[6] ..... E02D 27/34; E04B 1/98; E04H 9/02

[52] U.S. Cl. ..... 52/167.1; 52/167.6; 52/167.8

[58] Field of Search ..... 52/167.1, 167.6, 52/167.8; 248/638, 631, 624, 562

[56] References Cited

U.S. PATENT DOCUMENTS

| | | | |
|---|---|---|---|
| 2,001,169 | 5/1935 | Wallace | 52/167.1 |
| 2,597,800 | 5/1952 | Hussman | 52/167.1 |
| 3,794,277 | 2/1974 | Smedley et al. | 52/167.1 |
| 4,533,109 | 8/1985 | Delam | 52/167.1 |
| 4,662,133 | 5/1987 | Kondo | 52/167.6 |
| 4,726,161 | 2/1988 | Yabhoubian . | |
| 4,883,250 | 11/1989 | Yano et al. | 52/167.6 |
| 5,056,280 | 10/1991 | Shustov . | |
| 5,310,156 | 5/1994 | Matsumura et al. | 52/167.1 |
| 5,363,610 | 11/1994 | Thomas et al. . | |
| 5,740,652 | 4/1998 | Inone et al. . | |

FOREIGN PATENT DOCUMENTS

| | | | |
|---|---|---|---|
| 1-182415 | 7/1989 | Japan . | |
| 1-226952 | 9/1989 | Japan . | |
| 2-285176 | 11/1990 | Japan . | |
| 3-3726 | 1/1991 | Japan . | |
| 4-115068 | 4/1992 | Japan . | |
| 5-14995 | 4/1993 | Japan . | |
| 5-248493 | 9/1993 | Japan . | |
| 5-322008 | 12/1993 | Japan . | |
| 406010533 | 1/1994 | Japan | 52/167.1 |
| 1689522A1 | 11/1991 | U.S.S.R. | 52/167.6 |

*Primary Examiner*—Carl D. Friedman
*Assistant Examiner*—Dennis L. Dorsey
*Attorney, Agent, or Firm*—Smith, Gambrell & Russell, LLP

[57] ABSTRACT

An earthquake-proof foundation includes post trunk portions supported on separate post root portions. In an embodiment, fracturable struts and a cushioning member also are present to support the trunk portions on the post root portions. The struts will fracture under the force of seismic activity of a certain intensity whereafter the post trunk portion will be supported on the post root portions by the cushioning members. In another embodiment, the post root portions are arranged to store a liquid that is discharged during seismic activity to cushion between the post trunk portions and the post root portions. A building incorporating such an earthquake-proof foundation also is contemplated.

9 Claims, 3 Drawing Sheets

EARTHQUAKE-PROOF FOUNDATION

This application is 371 of PCT/JP96/00357 filed on Feb. 19, 1996.

BACKGROUND OF THE INVENTION

Technical Field and Disclosure of the Invention

This invention has been designed as a building capable of withstanding both horizontal and vertical shaking in a big earthquake.

SUMMARY OF THE INVENTION

There has been enormous expense required for constructing an earthquake-proof structure. The object of the present invention is to reduce the expense greatly. Consequently, a large demand for the foundation, and a building including this foundation of the present invention, can be expected. What is specially elaborated in this invention resides in a foundation on which posts are supported.

DETAILED DESCRIPTION OF THE INVENTION

Figure 1:
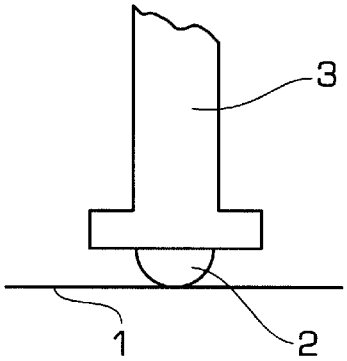
FIG. 1 is a schematic diagram showing the condition of posts 3 placed via hemispherical steel members 2 on a flat steel plate 1 fixed on a ground surface.

The foundation is formed by placing posts 3 via hemispherical steel members 2 on a flat steel plate 1 fixed on the ground surface as shown in FIG. 1. Consequently, the movement of the hemispherical members on the steel plate is made under the same conditions in all directions. An oil spread on the surface of the steel plate keeps small the sliding frictional force occurring between the hemispherical members and steel plate. This prevents the hemispherical members, i.e., a building standing thereon from moving in accordance with a lateral movement of the ground surface.

Figure 2:
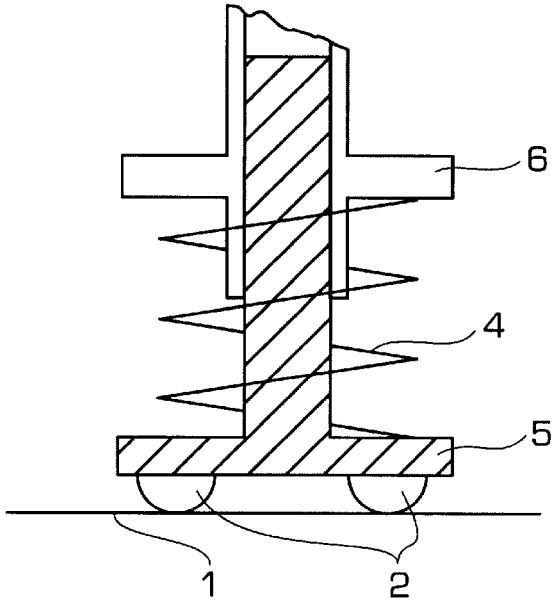
FIG. 2 is a schematic side elevation showing a structure of a base portion of a post placed on a hemispherical member 2, which structure comprises a post root portion 5, and a post trunk portion 6 formed separately from each other via a cushioning member 4.
Figure 3:
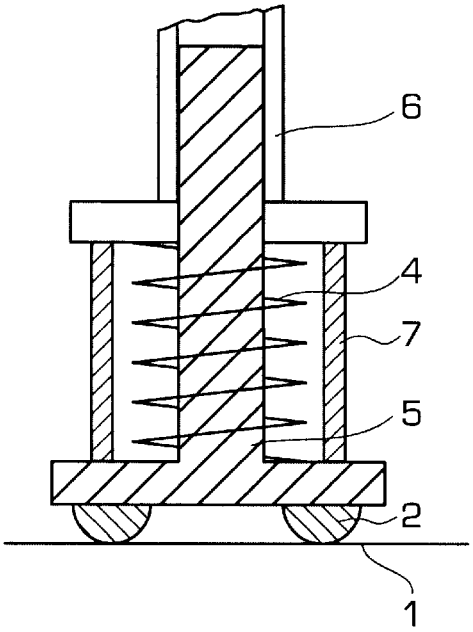
FIG. 3 is a schematic side elevation showing the same as shown in FIG. 2 with additionally provided four struts 7 further supporting the post trunk portion 6.

Regarding the vertical shaking of the ground, the structures of post base portions placed on the hemispherical members shall comprise post root portions 5 and post trunk portions 6 separately formed via cushioning members 4 as shown in FIG. 2, or, in addition to the above-mentioned separated structures, four struts 7 further supporting the post trunk portions 6 as shown in FIG. 3. The purpose of using these struts 7 resides in the following. When a load on the post trunk portions 6 is comparatively large, the cushioning members 4, only on which the post trunk portions 6 are supported, receive a large load constantly, so that the parts have to be replaced very frequently since there is a limit to the elastic fatigue resistance of the cushioning members. Therefore, in order to reduce the cost, the foundation is formed so that the post trunk portions 6, i.e., a building is normally supported on these four struts 7, and so that the cushioning members 4 function only when shaking is so great that it will damage the building should it occur. In a method of achieving this object, the fracture strength of the struts 7 is set equal to a target seismic intensity (seismic intensity at which the struts 7 are desired to be broken). When an earthquake the seismic intensity of which is not lower than the set level then occurs, the struts 7 are broken, and the cushioning members 4 function. The foundation shown in FIG. 2 is adapted to directly support a load imparted thereto on the cushioning members 4, and it is used when a load is comparatively small and does not necessitate the replacement of the parts of the cushioning members frequently.

Figure 4:
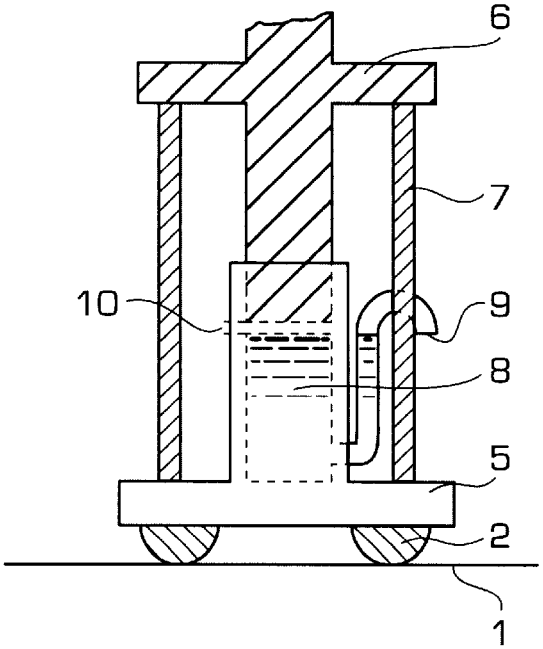
FIG. 4 is a schematic side elevation of a simple cushioning member in which a post root portion 5 and a post trunk portion 6 offer a cushioning function (function of a shock absorber) in which a space 8 contains water or an oil; and a reference numeral 9 denotes a discharge port for such a liquid functioning as a shock absorber, and 10 a liquid injection port.
Figure 5:
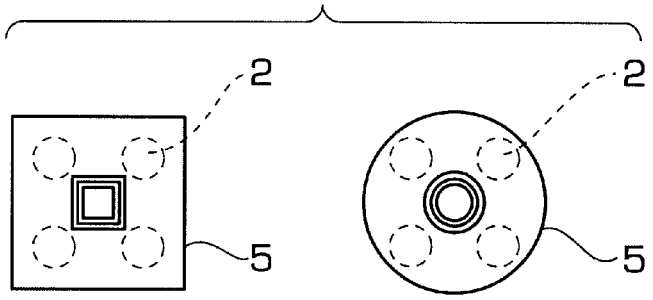
FIG. 5 is a schematic plan showing the way of combining square and round post root portions 5 and post trunk portions 6.

In the case of a large weight structure, such as an expressway, post root portions 5 and post trunk portions 6 can provide a cushioning function (function of shock absorbers) as shown in FIG. 4. In FIG. 4, a space 8 contains water or an oil, and a reference numeral 9 denotes a discharge port for such a liquid functioning as a shock absorber, and numeral 10 a liquid injection port, whereby the equipment cost of the cushioning members can be greatly reduced. The hemispherical members 2 are fixed to the lower sides of the four struts 7. The schematic shapes of the post root portions 5 and post trunk portions 6 can be set to either a square shape or a round shape as shown in FIG. 3.

Figure 6:
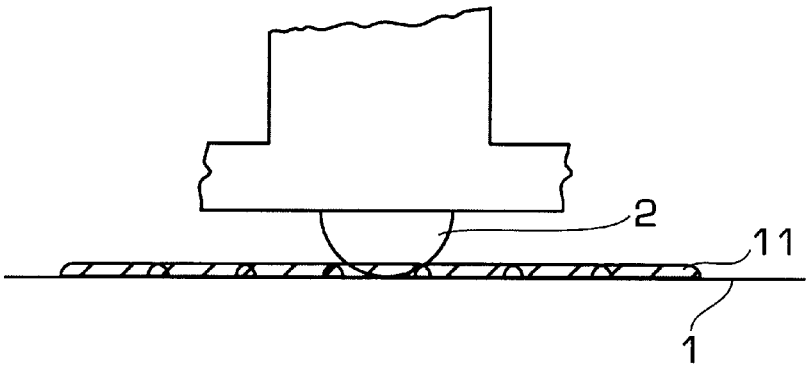
FIGS. 6 and 7 are schematic side elevations showing antislipping projections 11 of a ripple pattern formed on the surfaces of steel plates 1.
Figure 7:
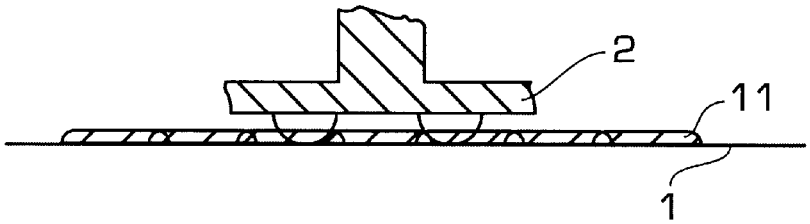
Figure 8:
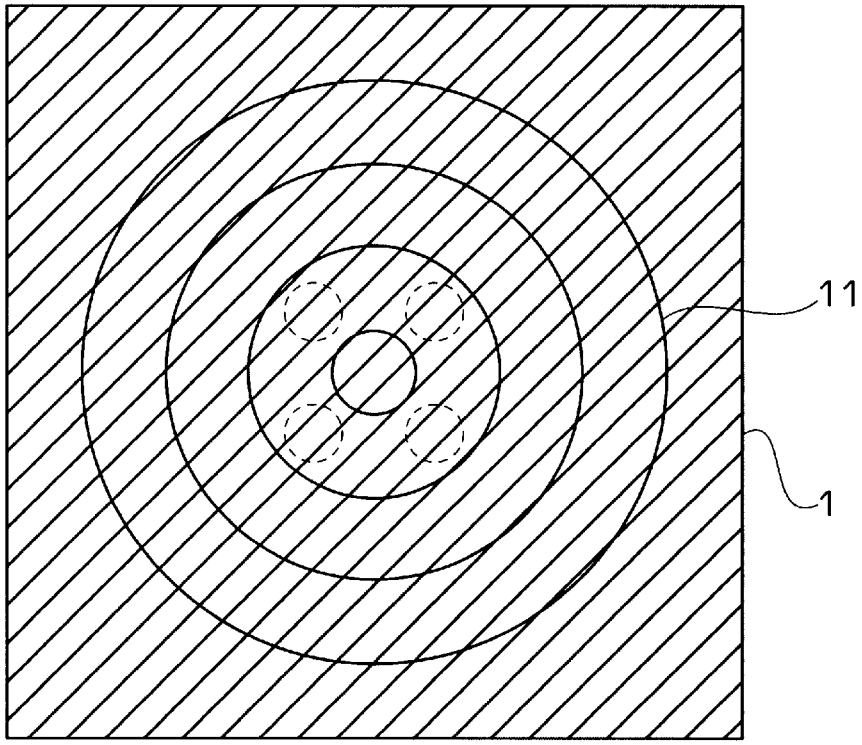
FIG. 8 is a schematic plan of what are shown in FIGS. 6 and 7.

In order to prevent the hemispherical members 2 from sliding on the steel plate by any chance in a normal condition, or from sliding due to a big earthquake and continuing to slide limitlessly, or from secondarily sliding due to incline in the steel plate after a seismic vibration has ceased, the surface of the steel plate 1 is provided with antislipping projections 11 of a ripple pattern having a certain height as shown in FIGS. 6, 7 and 8.

Figure 9:
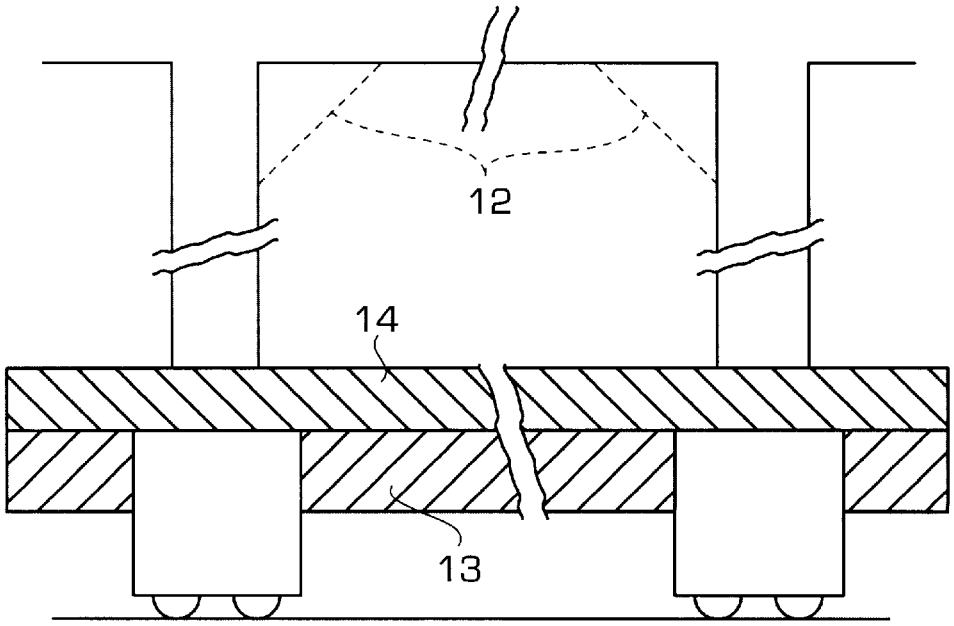
FIG. 9 is a schematic side elevation showing the condition of posts connected together at their root portions by a member 13, and the condition of a basement floor 14 set on such members 13 used as beams.

Finally, when a lateral force is exerted on the post base portions, the moment of a large rotational force is imparted to the ceiling portions of the posts. Accordingly, large-scale braces 12 (refer to FIG. 9) for reinforcing the posts are required. Therefore, when the foundation is used for a certain purpose, the posts are connected together, if possible, at the root portions thereof by members 13 as shown in FIG. 9, whereby the moment of a rotational force imparted to the ceiling portions of the posts can be reduced to a low level, so that small-scale braces can be used. When the foundation is used for another purpose, using these members 13 as beams, and setting a basement floor 14 on the beams offer an effective construction method.

Best Mode for Carrying Out the Invention

All that are described under "Technical Field and Disclosure of the Invention."

I claim:

1. An earthquake-proof foundation comprising:

post root portions, post trunk portions supported upon said post root portions, struts for supporting said trunk portions on said post root portions, said struts being fracturable by seismic activity at a certain intensity, cushioning members for supporting said trunk portions on said post root portions in the event of fracture of said struts due to seismic activity at or exceeding said certain intensity, and a flat plate fixed on a ground surface, wherein said post root portions are placed on said flat plate, and said flat plate is provided with concentric speed reducing projections.

2. A foundation as claimed in claim 1, wherein said post root portions each terminate in a hemispherical member.

3. A building having a plurality of earthquake-proof foundations according to claim 1, wherein adjacent of said earthquake-proof foundations are connected by beam members.

4. A building comprising:

post trunk portions:

a basement floor supporting said post trunk portions; post root portions; and beam members connecting adjacent of said post root portions, wherein said post root portions and said beam members support said basement floor.

5. An earthquake-proof foundation comprising:

a post-root portion, a post trunk portion on said post root portion, and said post root portion including means for containing a liquid and receiving said post trunk portion therein whereby said foundation has a cushioning function in which liquid is pushed out of a discharge port in said liquid containing means when said post trunk portions are moved by seismic activity.

6. A building having a plurality of earthquake-proof foundations according to claim 5, wherein adjacent of said earthquake-proof foundations are connected by beam members.

7. An earthquake-proof foundation as claimed in claim 5, further comprising struts for supporting said trunk portions on said post root portions, said struts being fracturable by seismic activity at a certain intensity.

8. A building having a plurality of earthquake-proof foundations according to claim 5.

9. A foundation as claimed in claim 5, wherein said post root portion terminates in a hemispherical member.

* * * * *